US011890661B2

(12) United States Patent
Li et al.

(10) Patent No.: US 11,890,661 B2
(45) Date of Patent: Feb. 6, 2024

(54) ELECTROMAGNETIC STAMPING METHOD AND DEVICE

(71) Applicant: HEFEI UNIVERSITY OF TECHNOLOGY, Anhui (CN)

(72) Inventors: Lei Li, Anhui (CN); Haihong Huang, Anhui (CN); Haojie Sang, Anhui (CN); Mengxiao Yang, Anhui (CN); Qingyu Lyu, Anhui (CN); Lei Gan, Anhui (CN); Libin Zhu, Anhui (CN); Zhifeng Liu, Anhui (CN)

(73) Assignee: HEFEI UNIVERSITY OF TECHNOLOGY, Anhui (CN)

( * ) Notice: Subject to any disclaimer, the term of this patent is extended or adjusted under 35 U.S.C. 154(b) by 121 days.

(21) Appl. No.: 17/700,173

(22) Filed: Mar. 21, 2022

(65) Prior Publication Data

US 2023/0008562 A1 Jan. 12, 2023

Related U.S. Application Data

(63) Continuation of application No. PCT/CN2021/107446, filed on Jul. 20, 2021.

(30) Foreign Application Priority Data

Jul. 6, 2021 (CN) ..... 202110764154.8
Jul. 6, 2021 (CN) ..... 202110765053.2

(51) Int. Cl.
*B21D 26/14* (2006.01)

(52) U.S. Cl.
CPC ..... *B21D 26/14* (2013.01)

(58) Field of Classification Search
CPC ..... B21D 22/22; B21D 24/04; B21D 24/10; B21D 26/14
(Continued)

(56) References Cited

U.S. PATENT DOCUMENTS

2007/0032900 A1 2/2007 Venugopal et al.

FOREIGN PATENT DOCUMENTS

CN 1631662 A 6/2005
CN 101259500 A 9/2008
(Continued)

OTHER PUBLICATIONS

CNIPA, First Office Action for CN Application 202110764154.8, dated Feb. 9, 2022.

(Continued)

*Primary Examiner* — Katrina M Stransky
*Assistant Examiner* — P Derek Pressley
(74) *Attorney, Agent, or Firm* — Hodgson Russ LLP

(57) ABSTRACT

The present disclosure relates to an electromagnetic stamping method and an electromagnetic stamping device. The electromagnetic stamping method includes: dividing a blank holder of a stamping device into a plurality of blank holder areas based on a contour characteristic of a workpiece to be stamped; setting a blank holder force function over time for each blank holder area based on a shape characteristic of the blank holder area; collecting blank holder force data of each blank holder area every cycle period t0, and calculating an error between the blank holder force data and a value of the blank holder force function at a current time; and controlling a blank holder force for each blank holder area based on the error, and obtaining the workpiece to be stamped by stamping sheet material under the blank holder force.

17 Claims, 6 Drawing Sheets

(58) Field of Classification Search
USPC ..... 72/350, 351
See application file for complete search history.

(56) References Cited

FOREIGN PATENT DOCUMENTS

| | | | | | |
|---|---|---|---|---|---|
| CN | 102527806 | A | | 7/2012 | |
| CN | 204308008 | | | 5/2015 | |
| CN | 107756867 | | | 3/2018 | |
| CN | 108286476 | | | 7/2018 | |
| CN | 108405688 | A | * | 8/2018 | ..... B21D 22/02 |
| CN | 111085594 | | | 5/2020 | |
| CN | 111151633 | A | | 5/2020 | |
| CN | 111266452 | | | 6/2020 | |
| CN | 111266452 | A | * | 6/2020 | |
| CN | 111940586 | | | 11/2020 | |
| CN | 111957829 | | | 11/2020 | |
| DE | 4229155 | | | 3/1994 | |
| IN | 108465725 | | | 8/2018 | |
| RU | 2723857 | | | 6/2020 | |

OTHER PUBLICATIONS

CNIPA, First Office Action for CN Application 202110765053.2, dated Feb. 9, 2022.
WIPO, International Search Report and Written Opinion for PCT/CN2021/107466, dated Apr. 6, 2022.

* cited by examiner

ELECTROMAGNETIC STAMPING METHOD AND DEVICE

CROSS-REFERENCE TO RELATED APPLICATIONS

This application is a continuation application of International Application No. PCT/CN2021/107446, filed on Jul. 20, 2021, which claims priority to Chinese Patent Applications No. 202110764154.8 and 202110765053.2, both filed on Jul. 6, 2021. The entire disclosures of the above-mentioned applications are incorporated by reference herein.

TECHNICAL FIELD

The present disclosure relates to a field of stamping technology, in particular to an electromagnetic stamping method and an electromagnetic stamping device.

BACKGROUND

Stamping forming process is a main aspect of metal technology of plasticity, which is characterized by high production efficiency and low surface roughness, and one-step formation can be achieved for complex workpieces. Blank holder force controlling plays a vital role in the forming quality of stamping workpieces, the stress and strain state of the sheet material during stamping, and the energy consumption during the stamping process.

SUMMARY

In order to overcome the problems in the related art, the present disclosure provides an electromagnetic stamping method and an electromagnetic stamping device.

The embodiments of the present disclosure provide an electromagnetic stamping method. The method includes: dividing a blank holder of a stamping device into a plurality of blank holder areas based on a contour characteristic of a workpiece to be stamped; setting a blank holder force function over time for each blank holder area based on a shape characteristic of the blank holder area; collecting blank holder force data G of each blank holder area every cycle period t0, and calculating an error e between the blank holder force data G and a value F of the blank holder force function at a current time, where e=F−G; and controlling a blank holder force for each blank holder area based on the error, and obtaining the workpiece to be stamped by stamping the sheet material under the blank holder force.

The embodiments of the present disclosure provide an electromagnetic stamping device. The device includes: a blank holder, having a plurality of blank holder areas divided based on a contour characteristic of a workpiece to be stamped; a plurality of pressure sensors, having a one-to-one correspondence with the plurality of blank holder areas, in which each pressure sensor is configured to collect blank holder force data G of a corresponding blank holder area every cycle period 10; and a controller, configured to control a blank holder force for each blank holder area based on an error between the blank holder force data G and a value F of a blank holder force function set over time for the blank holder area at a current time, where e=F−G, and to obtain the workpiece to be stamped by stamping the sheet material under the blank holder force.

It should be understood that the above general description and the following detailed description are only exemplary and explanatory, and cannot limit the present disclosure.

BRIEF DESCRIPTION OF THE DRAWINGS

The accompanying drawings, which are incorporated in and constitute a part of this specification, illustrate embodiments consistent with the present disclosure and, together with the description, serve to explain the principles of the present disclosure.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the present disclosure. Instead, they are merely examples of apparatuses and methods consistent with aspects related to the present disclosure as recited in the appended claims.

In related arts, existing hydraulic and electromagnetic blanking technology has caused serious energy waste during blanking, and does not take into account the need for dynamic changes of the blank holder force on each blank holder block during the stamping process.

Although the electrically-controlled permanent magnetic blank holder technology can solve the energy problem to a certain extent, the existing electrically-controlled permanent magnetic chuck is not accurate enough in terms of loading the blank holder force.

The present disclosure provides an electromagnetic stamping method, an electromagnetic stamping device and a storage medium. In detail, the present disclosure is an electric permanent magnetic distributed blanking method and a blanking device for a stamping process. The solution of the present disclosure provides various blank holder forces for forming areas with different characteristics at different stamping stages, and uses a negative feedback mechanism to dynamically monitor the blank holder force in real time, so as to improve the loading accuracy of the blank holder force, thereby accurately controlling the metal flow of the sheet material, optimizing the forming quality, reducing the energy consumption, and avoiding the defects of cracking, wrinkling and springback of the workpiece.

The electromagnetic stamping method, the electromagnetic stamping device and the storage medium of the embodiments of the present disclosure are described below with reference to the accompanying drawings.

Figure 1:
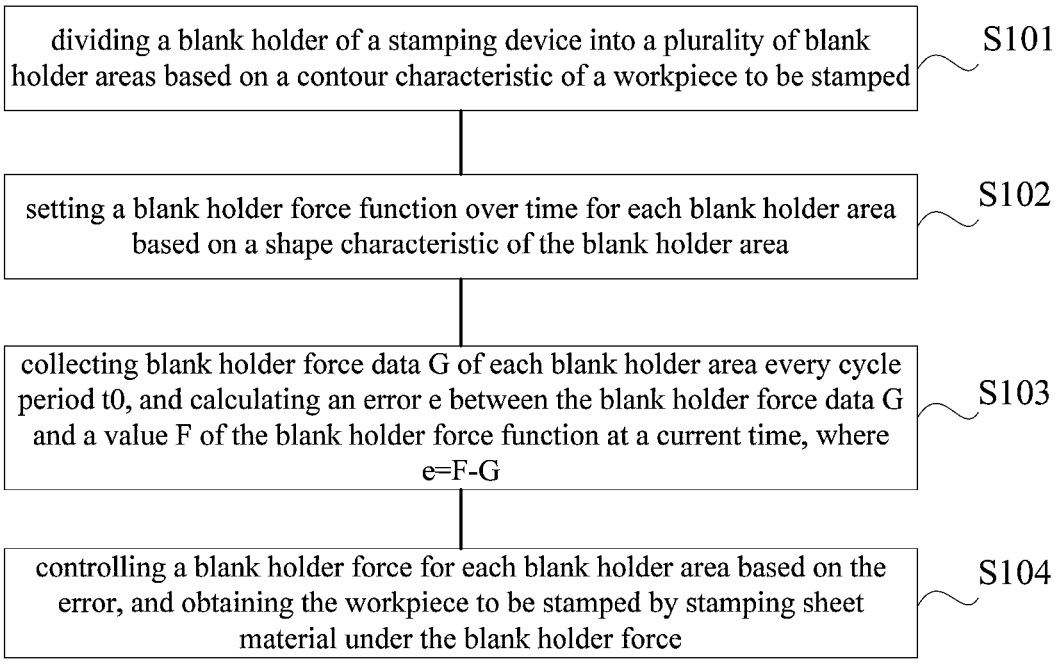
FIG. 1 is a flowchart illustrating an electromagnetic stamping method according to an embodiment of the present disclosure.

FIG. 1 is a flowchart illustrating an electromagnetic stamping method according to an embodiment of the present disclosure. The embodiments of the present disclosure take the stamping method performed by a stamping device as an example. The stamping device can be applied to but not limited to an electric permanent magnet distributed stamping system. A controller of the stamping device may execute a proportion integration differentiation (PID) control program, to cause the stamping device to execute a stamping process.

As shown in FIG. 1, the stamping method of the present disclosure includes the following steps.

In step S101, a blank holder of a stamping device is divided into a plurality of blank holder areas based on a contour characteristic of a workpiece to be stamped.

In the embodiments of the present disclosure, the workpiece to be stamped may be of any shape, and the contour characteristic of which includes at least one of straight lines and curves, and a closed outer contour of the workpiece to be stamped may be formed by several straight lines or curves connected end to end.

In the embodiments of the present disclosure, the blank holder of the stamping device is divided into s areas in a circumferential direction, the $i^{th}$ area is divided into ki blank holder areas in a radial direction, a certain blank holder area is denoted as Aij, where $i \in \{1, 2, \ldots, s\}$, $j \in \{1, 2, \ldots, ki\}$.

In step S102, a blank holder force function over time is set for each blank holder area based on a shape characteristic of the blank holder area.

Since a shape of the blank holder area and a stage of the stamping process affect the control of the blank holder force and the quality of the workpiece, each blank holder area is loaded with a variable blank holder force over time in the present disclosure. In order to accurately control the blank holder force for each blank holder area, the blank holder force function over time is set for each blank holder area based on the shape characteristic of the blank holder area, for example, whether the blank holder area has right angles, rounded corners, arcs, or a special shape formed by multiple lines, and stages of the stamping process (which are reflected as time parameters).

It can be understood that different blank holder areas correspond to different blank holder force functions, and values of the blank holder force function in the same area may be different at different moments, the blank holder force function is represented as $Fij=f(tij)$, where a blank holder force Fij corresponds to a blank holder area Aij, and tij is a time variable representing a duration for the sheet material to flow radially from an outer edge to an inner edge of the area Aij during the stamping process. For the blank holder area Aij, a current value of the blank holder force function is represented as $Fij=P\times S$, where P represents a pressure required for applying a blank holder force on the sheet material at the present moment, and S represents a contact area between the sheet material and the blank holder area at the present moment. In a duration tij, the contact area of the sheet material on the area Aij is continuously reduced, the required pressure of the sheet material is constantly changing, causing the function $Fij=f(tij)$ also changing accordingly. A shape characteristic of an area may be a fixed parameter of the function, a specific value of which is not limited herein.

A current value of the blank holder force function is $F=P\times S$, where P represents a pressure required to stamp the sheet material at the moment, and S represents the contact area between the sheet material and the blank holder area at the moment. When the edge of the sheet material is leaving away from the inner edge of the blank holder area, the contact area between the sheet material and the blank holder area is 0, that is, the value of the blank holder force function is 0. In other words, as the stamping process progresses and time changes, the outer edge of the sheet material flows from the outer edge of a certain blank holder area to the inner edge of the blank holder area, and the contact area between the sheet material and the blank holder area decreases. When the edge of the sheet material is leaving away from the inner edge of the blank holder area, the contact area is 0, that is, $Fij=f(tij)$ is 0, so that there will be no collision among the blank holder blocks under the action of the blank holder force when the sheet material is leaving away from the blank holder block.

In step S103, blank holder force data G of each blank holder area is collected every cycle period t0, and an error e between the blank holder force data G and a value F of the blank holder force function is calculated at a current time, where $e=F-G$.

In the embodiments of the present disclosure, in order to make the change of the actual blank holder force strictly conform to the curve of the blank holder force function, so as to make a suitable blank holder force applied at each stage of the stamping process, a counter Nij is provided for the stamping device. In particular, the counter is set in the controller, which is configured to simulate time changes. The counter is incremented by one every cycle period t0, the controller will perform a PID control program according to a new value of the blank holder force. The current value of the counter is n, and when n reaches a set value n0 of the counter, the stamping process ends.

For example, a cyclic interrupt program is built in a PID control program Cij, and a cycle period of the cyclic interrupt program is t0. The controller of the stamping device may control the PID instruction to run cyclically. For each blank holder area, the blank holder force data G is collected every cycle period t0, and an error e between the blank holder force data G and the value F of the blank holder force function at the current time is calculated, where $e=F-G$. An actual value of blank holder force may be controlled to be close to a real-time value of the function by controlling the error.

In step S104, a blank holder force for each blank holder area is controlled based on the error, and the workpiece to be stamped is obtained by stamping sheet material under the blank holder force.

In the embodiments of the present disclosure, a blank holder force for each blank holder area is controlled based on the error e between the blank holder force data G and the value F of the blank holder force function at the current time (where $e=F-G$), to make the actual blank holder force close to the value of the blank holder force function at the moment of collecting the blank holder force data G, and the workpiece to be stamped may be obtained by stamping the sheet material under the blank holder force.

In the embodiments of the present disclosure, the stamping method of the present disclosure further includes: collecting deformation data of the sheet material every cycle period t0, sending an alarm instruction and stopping stamping in response to the deformation data being greater than 1.5 times an initial thickness of the sheet material.

It may be understood that the sheet material subjected to a force deforms and flows during the stamping process. The deformation data of the sheet material may be the thickness of the sheet material. The stamping device is equipped with a displacement sensor for each blank holder area, the displacement sensor is configured to collect the thickness of the sheet material every cycle period t0. When the real-time thickness of the sheet material is greater than 1.5 times the initial thickness of the sheet material, it indicates that the sheet material is severely wrinkled. At this time, an alarm instruction is issued to stop the stamping.

Optionally, the deformation data of the sheet material may also be any data that can indicate the deformation state of the sheet material, such as a change rate of the thickness of the sheet material or a fluidity degree of the sheet material, which is not limited herein.

The deformation data can also be used to assist in controlling the blanking process, for example, the deformation data is fed back to the controller of the stamping device in real time, to control the blank holder force in real time. Deformation data can also be used for quality analysis of a workpiece to be stamped.

Therefore, according to the stamping method of the embodiments of the present disclosure, a blank holder of a stamping device is divided into a plurality of blank holder areas based on a contour characteristic of a workpiece to be stamped. A blank holder force function over time is set for each blank holder area based on a shape characteristic of the blank holder area. Blank holder force data G of each blank holder area is obtained every cycle period t0, and an error e between the blank holder force data G and a value F of the blank holder force function at a current time is calculated, where e=F−G. A blank holder force for each blank holder area is controlled based on the error, and the workpiece to be stamped is obtained by stamping the sheet material under the blank holder force. In this way, it is possible to provide various blank holder forces for forming areas with different characteristics at different stamping stages. At the same time, the negative feedback mechanism is used to monitor the blank holder force dynamically in real time, so as to improve the loading accuracy of the blank holder force, and accurately control the metal flow of the sheet material, optimize molding quality, reduce energy consumption, and avoid molding cracks, wrinkles and springback defects.

Figure 2:
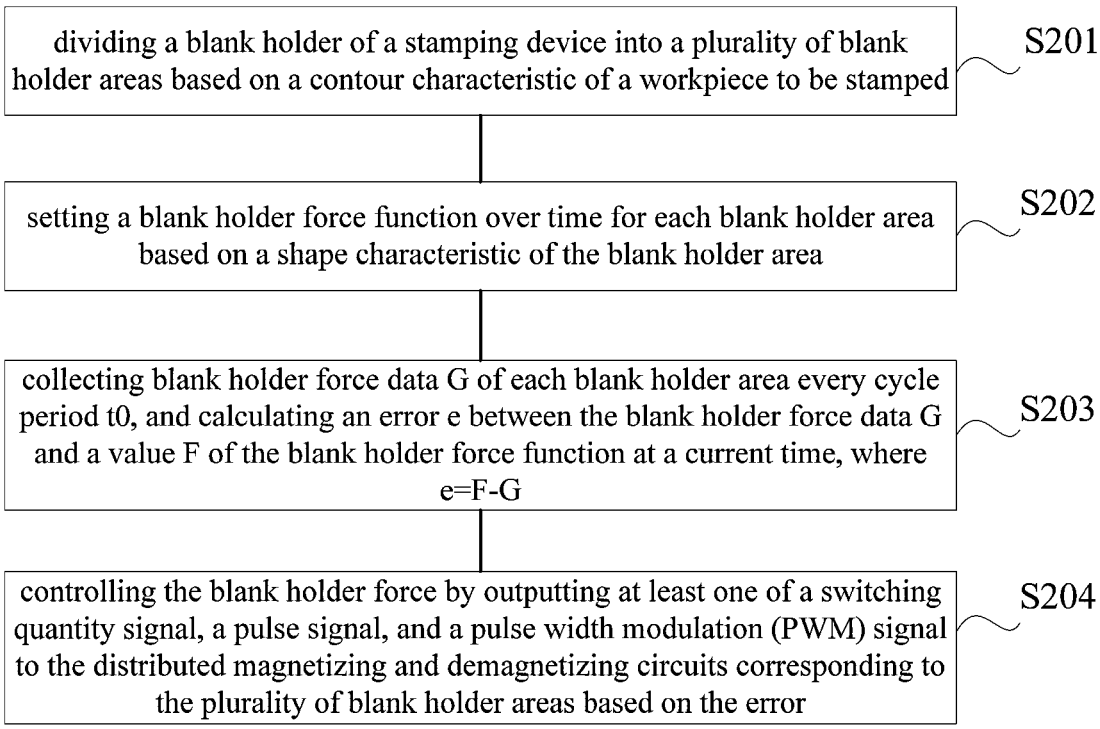
FIG. 2 is a flowchart illustrating an electromagnetic stamping method according to another embodiment of the present disclosure.

FIG. 2 is a flowchart illustrating an electromagnetic stamping method according to another embodiment of the present disclosure. This embodiment specifically describes step S104 based on the embodiment corresponding to FIG. 1. As shown in FIG. 2, the stamping method includes the following steps.

In step S201, a blank holder of a stamping device is divided into a plurality of blank holder areas based on a contour characteristic of a workpiece to be stamped.

In step S202, a blank holder force function is set over time for each blank holder area based on a shape characteristic of the blank holder area.

In step S203, blank holder force data G of each blank holder area is collected every cycle period t0, and an error e between the blank holder force data G and a value F of the blank holder force function at a current time is calculated, where e=F−G.

The execution process of steps S201 to S203 refer to the execution process of S101 to S103 in the foregoing embodiments, which is not elaborated herein.

In step S204, the blank holder force is controlled by outputting at least one of a switching quantity signal, a pulse signal, and a pulse width modulation (PWM) signal to the distributed magnetizing and demagnetizing circuits corresponding to the plurality of blank holder areas based on the error.

In the embodiments of the present disclosure, the stamping device includes a plurality of distributed magnetizing and demagnetizing circuits Uij, an electronically-controlled permanent magnetic chuck, and a force-enhancing plate corresponding to each blank holder area. A blank holder unit Dij is formed by an electronically-controlled permanent magnetic chuck, a force-enhancing plate, and a pressure sensor corresponding to each blank holder area. The distributed magnetizing and demagnetizing circuit magnetizes and demagnetizes the electronically-controlled permanent magnetic chuck by outputting a pulse current, and the electronically-controlled permanent magnetic chuck is magnetized and demagnetized by the pulse current output by the distributed magnetizing and demagnetizing circuit Uij, to generate the blank holder force by attracting the force-enhancing plate. The blank holder force generated by the electronically-controlled permanent magnetic chuck is stable and continuous, which improves the loading capacity of the blank holder force and reduces the energy consumption of the blank holder process.

In particular, due to the limited area of each blank holder area, applying the electronically-controlled permanent magnetic chuck directly to each blank holder area may result in insufficient or unstable blank holder force. The stamping device of the present disclosure is designed with a force-enhancing plate, the force-enhancing plate corresponds to each blank holder area correspondingly, and is arranged at a position parallel to the blank holder block. A ring-shaped plate is enclosed around the periphery of the blank holder area, the shape and area of which are determined by the electronically-controlled permanent magnetic chuck. The force-enhancing plate is connected to the blank holder block corresponding to each blank holder area through a connecting rod, and the electronically-controlled permanent magnetic chuck is arranged corresponding to the force-enhancing plate, so that the electronically-controlled permanent magnetic chuck is magnetized and demagnetized through the pulse current output by the distributed magnetizing and demagnetizing circuit Uij, the force-enhancing plate generates the blank holder force, thereby improving the loading capacity and stability of the blank holder force of each blank holder block.

Therefore, in the stamping method of the embodiments of the present disclosure, the stamping device includes a plurality of distributed magnetizing and demagnetizing circuits corresponding to the plurality of blank holder areas respectively. The blank holder of the stamping device is divided into a plurality of blank holder areas based on the contour characteristic of the workpiece to be stamped. The blank holder force function over time is set for each blank holder area based on the shape characteristic of the blank holder area. Blank holder force data G of each blank holder area is collected every cycle period t0, and an error e between the blank holder force data G and a value F of the blank holder force function at a current time is calculated, where e=F-G.

The blank holder force is controlled by outputting at least one of a switching quantity signal, a pulse signal, and a pulse width modulation (PWM) signal to the distributed magnetizing and demagnetizing circuits corresponding to the plurality of blank holder areas based on the error. Therefore, the control accuracy of the blank holder force is improved, the influence of multi-magnetic field coupling and external interference is reduced, the blank holder force generated by the electronically-controlled permanent magnetic chuck is stable and continuous, which improves the loading capacity of the blank holder force and reduces the energy consumption of the blanking process.

Figure 3:
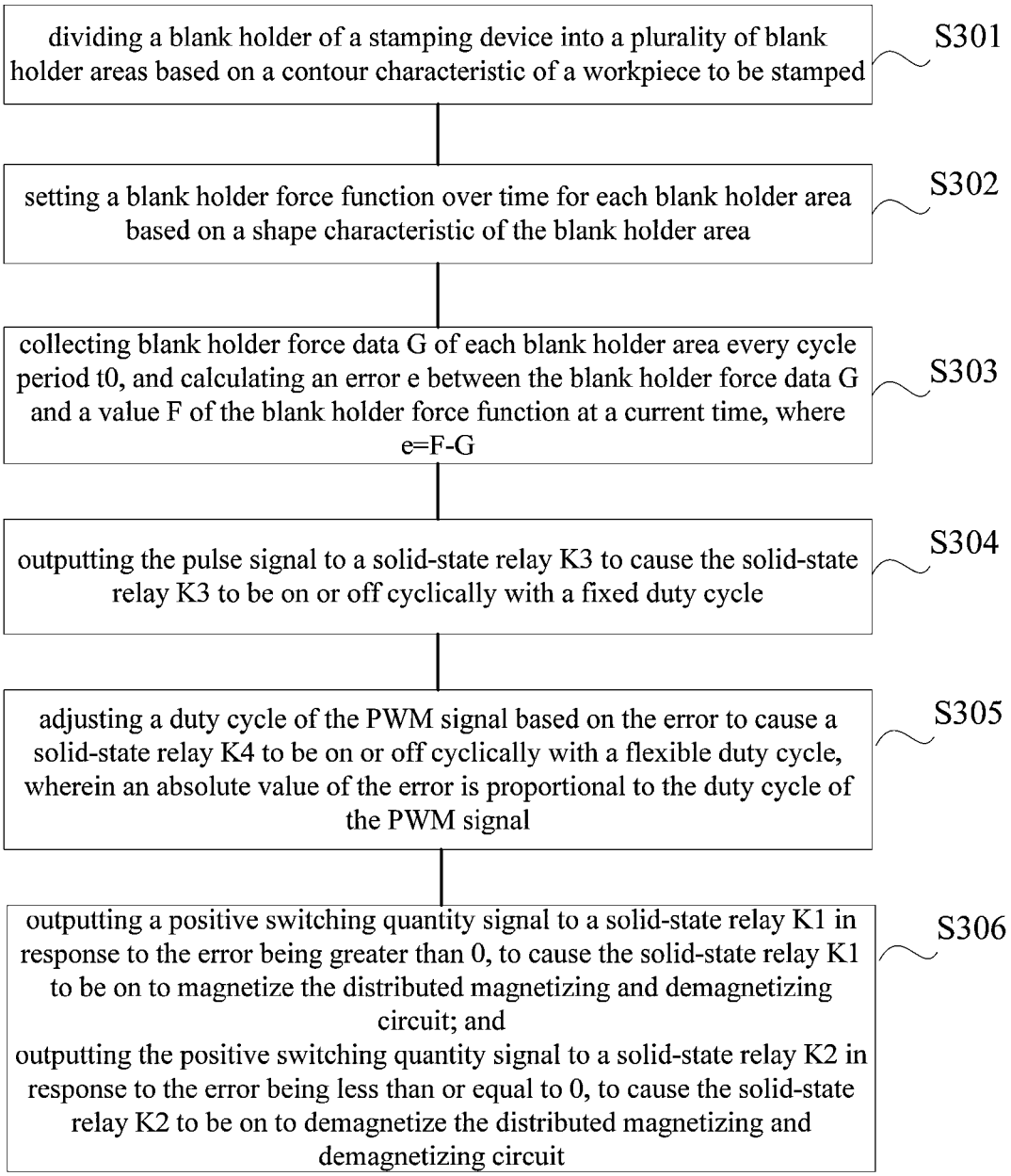
FIG. 3 is a flowchart illustrating an electromagnetic stamping method according to yet another embodiment of the present disclosure.

FIG. 3 is a flowchart illustrating an electromagnetic stamping method according to an embodiment of the present disclosure. This embodiment specifically describes step S204 based on the embodiment corresponding to FIG. 2. As shown in FIG. 3, the stamping method includes the following steps.

In step S301, a blank holder of a stamping device is divided into a plurality of blank holder areas based on a contour characteristic of a workpiece to be stamped.

In step S302, a blank holder force function is set over time for each blank holder area based on a shape characteristic of the blank holder area.

In step S303, blank holder force data G of each blank holder area is collected every cycle period t0, and an error e between the blank holder force data G and a value F of the blank holder force function at a current time is calculated, where e=F−G.

The execution process of steps S301 to S303 refer to the execution process of S101 to S103 in the foregoing embodiments, which is not elaborated herein.

In an embodiment, each distributed magnetizing and demagnetizing circuit includes four solid-state relays Ki, where i∈{1, 2, 3, 4}, Ki is in a disconnected state in an initial condition for stamping the sheet material. Step S204 further includes the following steps.

In step S304, the pulse signal is output to a solid-state relay K3 to cause the solid-state relay K3 to be on or off cyclically with a fixed duty cycle, in which a frequency of the pulse signal is greater than 5 times a frequency of the PWM signal.

In an embodiment, the controller outputs a signal to the distributed magnetizing and demagnetizing circuit Uij to cause the solid-state relay K1 to be on or off, so that the distributed magnetizing and demagnetizing circuit Uij outputs a pulse current.

The solid-state relay K3 is controlled to be on or off cyclically with a fixed duty cycle, so that the circuit outputs a pulse current for magnetizing and demagnetizing.

In step S305, a duty cycle of the PWM signal is adjusted based on the error to cause a solid-state relay K4 to be on or off cyclically with a flexible duty cycle, and an absolute value of the error is proportional to the duty cycle of the PWM signal.

In an embodiment, the solid-state relay K4 is controlled by the PWM signal, and is caused to be on or off cyclically with a flexible duty cycle, which represents a rate change for magnetizing and demagnetizing of the circuit.

For example, by executing the PID control program Cij, the controller can tune the PID parameters according to the error e, and then adjust the magnitude of the duty cycle of the output PWM signal, so that the solid state relay K4 is caused to be on or off cyclically with a flexible duty cycle. An absolute value of the error is proportional to the duty cycle of the PWM signal. That is, the greater the absolute value of the error e, the greater the duty cycle of the PWM signal, and the smaller the absolute value of the error e, the smaller the duty cycle of the PWM signal.

In step S306, a positive switching quantity signal is output to a solid-state relay K1 in response to the error being greater than 0, to cause the solid-state relay K1 to be on to magnetize the distributed magnetizing and demagnetizing circuit. The positive switching quantity signal is output to a solid-state relay K2 in response to the error being less than or equal to 0, to cause the solid-state relay K2 to be on to demagnetize the distributed magnetizing and demagnetizing circuit.

In the embodiment of the present disclosure, the solid state relay K1 and the solid state relay K2 in the distributed charging and demagnetizing circuit Uij are controlled by a switching quantity signal. The solid state relay K1 is closed, which means that the circuit is magnetized, and if the solid state relay K2 is closed, which means that the circuit is demagnetized. For example, when the controller executes the PID control program Cij, it is determined whether the error e is greater than 0. If the error e is greater than 0, a positive signal is output to the solid state relay K1 to close the solid state relay K1 to magnetize the circuit. If the error e is less than or equal to 0, a positive signal is output to the solid state relay K2, so that the solid state relay K2 is closed to demagnetize the circuit.

According to the stamping method of the embodiments of the present disclosure, each distributed magnetizing and demagnetizing circuit includes four solid-state relays K1, where i∈{1, 2, 3, 4}. The blank holder of the stamping device is divided into a plurality of blank holder areas based on a contour characteristic of a workpiece to be stamped. A blank holder force function is set over time for each blank holder area based on a shape characteristic of the blank holder area.

Blank holder force data G of each blank holder area is collected every cycle period t0, and an error e between the blank holder force data G and a value F of the blank holder force function at a current time is calculated, where e=F−G. The pulse signal is output to a solid-state relay K3 to cause the solid-state relay K3 to be on or off cyclically with a fixed duty cycle. A duty cycle of the PWM signal is adjusted based on the error to cause a solid-state relay K4 to be on or off cyclically with a flexible duty cycle. An absolute value of the error is proportional to the duty cycle of the PWM signal. A positive switching quantity signal is output to a solid-state relay K1 in response to the error being greater than 0, to cause the solid-state relay K1 to be on to magnetize the distributed magnetizing and demagnetizing circuit. The positive switching quantity signal is output to a solid-state relay K2 in response to the error being less than or equal to 0, to cause the solid-state relay K2 to be on to demagnetize the distributed magnetizing and demagnetizing circuit. Therefore, the distributed magnetizing and demagnetizing circuit is controlled by executing the PID control program, and the direction and speed of the pulse current of the distributed magnetizing and demagnetizing circuit are adjusted to magnetize and demagnetize the electronically-controlled permanent magnetic chuck, and the force-enhancing plate may be attracted to generate the blank holder force. The generated blank holder force is infinitely close to the value of the blank holder force function, and a suitable blank holder force can be applied at each stage of the stamping process, thereby improving the forming quality of the workpiece to be stamped. The real-time blank holder force in the blanking process is used as a feedback value, the negative feedback control mechanism adjusts the pulse current loading according to the magnitude of the feedback value, to weaken the influence of multi-magnetic field coupling and external interference, and to improve the control accuracy. In addition, by magnetizing and demagnetizing the electronically-controlled permanent magnetic chuck, a stable and continuous blank holder force is obtained, which improves the loading capacity of the blank holder force and reduces the energy consumption of the blank holder process.

Figure 4:
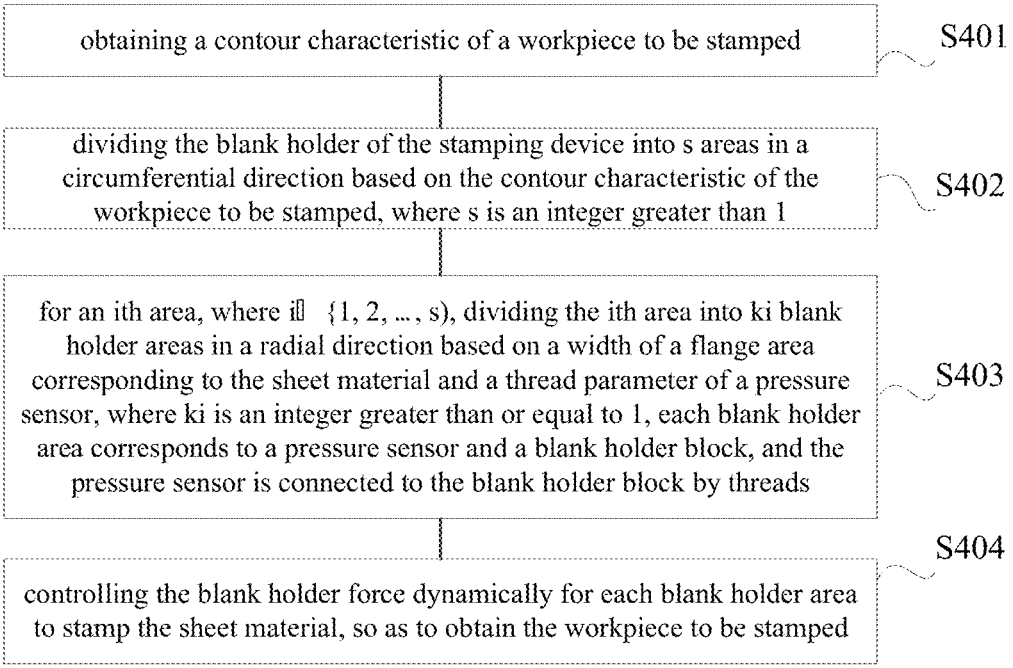
FIG. 4 is a flowchart illustrating an electromagnetic stamping method according to still another embodiment of the present disclosure.

FIG. 4 is a flowchart illustrating an electromagnetic stamping method according to another embodiment of the present disclosure. In this embodiment, step S101 is specifically described based on the embodiment corresponding to FIG. 1. As shown in FIG. 4, the stamping method includes the following steps.

In step S401, a contour characteristic of the workpiece to be stamped is obtained.

In the embodiment of the present disclosure, the workpiece to be stamped may be a multi-feature curved workpiece to be stamped, which may have any shape. On a two-dimensional plane, taking the outer contour of the workpiece to be stamped as an example, the contour characteristic may include at least one of straight lines and curves, and several straight lines or curves are connected end to end to form a closed outer contour of the workpiece to be stamped.

It is understood that obtaining the characteristic of the outer contour of the workpiece to be stamped is only an example of the present disclosure, and the characteristic of an inner contour of the workpiece to be stamped or the relationship between multiple independent inner contours can also be obtained.

In step S402, the blank holder of the stamping device into s areas in a circumferential direction based on the contour characteristic of the workpiece to be stamped, where s is an integer greater than 1.

For example, the outer contour of the workpiece to be stamped is formed by connecting m straight lines and n curves end to end. Any straight line is represented by Li ($i \in \{1, 2, \ldots, m\}$), and any curve is represented by Cj ($j \in \{1, 2, \ldots, n\}$). Connection types can be divided into any straight line connected to any curve, any curve connected to another curve, and any straight line connected to another straight line. According to the type of connection relationship formed by the contour characteristics of the workpiece to be stamped, the blank holder of the stamping device is divided into s areas in the circumferential direction.

In an embodiment, dividing the blank holder of the stamping device into s areas in the circumferential direction based on the contour characteristic of the workpiece to be stamped includes:

(1) in a case that a straight line La is connected to a curve Ca, determining an area formed by the straight line La, a first vertical line of the straight line La passing through one end point of the straight line La, a second vertical line of the straight line La passing through a connection point of the straight line La and the curve Ca, and a line segment between points where the first vertical line and the second vertical line intersect with an outer edge of the blank holder as a first area; determining an area formed by the curve Ca, a third vertical line perpendicular to a tangent line passing through one end of the curve Ca, the second vertical line, a curve between the points where the second vertical line and the third vertical line intersect with the outer edge of the blank holder as a second area, in which a curvature q at the connection point of the straight line La and the curve Ca is 0;

(2) in a case that a curve Cb is connected to a curve Cc and curvatures of the curve Cb and the curve Cc satisfy $(qmax-qmin)/qmax \geq 0.05$, determining an area formed by the curve Cb, a fourth vertical line perpendicular to a tangent line passing through one end point of the curve Cb, a fifth vertical line perpendicular to a tangent line passing through a connection point of the curve Cb and the curve Cc, and a curve between points where the fourth vertical line and the fifth vertical line intersect with the outer edge of the blank holder as a third area; and determining an area formed by the curve Cc, a sixth vertical line perpendicular to a tangent line passing through one end of the curve Cc, the fifth vertical line, and the curve between points where the fifth vertical line and the sixth vertical line intersect with the outer edge of the blank holder as a fourth area, where qmax represents a maximum value of curvatures of points on the curve Cb or the curve Cc, qmin represents a minimum value of the curvatures of points on the curve Cb or the curve Cc, and a curvature change rate at the connection point of the curve Cb and the curve Cc is the largest, in which, a curvature change rate at the connection point of the curve Cb and the curve Cc can be represented in differential dq/dl, where q is the curvature and l is the length of the curve, then $Max\{dq/dl\}$ is the connection point of the two curves, where the two curves are divided into the Cb curve area and the Cc curve area as two independent blank holder areas;

(3) in a case that the curve Cb is connected to the curve Cc and the curvature of the curve Cb and the curve Cc fails to satisfy $(qmax-qmin)/qmax \geq 0.05$, determining an area formed by the curve Cb, the curve Cc, the fourth vertical line, the sixth vertical line, and a curve between points where the fourth vertical line and the sixth vertical line intersect with the outer edge of the blank holder as a fifth area.

It is understandable that the curvature of the curve Cb and the curve Cc satisfying $(qmax-qmin)/qmax \geq 0.05$ is a condition for dividing the two curves into two blank holder areas. If $(qmax-qmin)/qmax < 0.05$, no division is performed on the two curves, that is, an area formed by an overall curve of the curve Cb and the curve Cc, and the two lines perpendicular to tangent lines passing through two end points of the curves and the curve between the points where the two perpendicular lines intersect the outer edge of the blank holder, is determined as a blank holder area.

It should be understood that in the actual stamping process, the workpiece to be stamped has rounded corners or chamfers. Therefore, the present disclosure does not consider the connection of straight lines.

In step S403, for an $i^{th}$ area, where $i \in \{1, 2, \ldots, s\}$, the $i^{th}$ area is divided into ki blank holder areas in a radial direction based on a width of a flange area corresponding to the sheet material and a thread parameter of a pressure sensor, where ki is an integer greater than or equal to 1, each blank holder area corresponds to a pressure sensor and a blank holder block, and the pressure sensor is connected to the blank holder block by threads.

In detail, the blank holder is divided into $\Sigma_{i=1}^{s} k_i$ blank holder areas on the two-dimensional plane, and any blank holder area is represented by Aij, where $i \in \{1, 2, \ldots, s\}$, and $j \in \{1, 2, \ldots, ki\}$. In the three-dimensional space, the blank holder is divided into $\Sigma_{i=1}^{s} k_i$ blank holder blocks, and any blank holder is represented as Yij, $i \in \{1, 2, \ldots, s\}$, and $j \in \{1, 2, \ldots, ki\}$.

It is understandable that the part where the blank is not completely pulled into the mold is a flange area. When the width of the flange area corresponding to the sheet material is large, in order to meet the stamping requirements, multiple blank holder blocks need to be arranged in the radial direction. By changing a time of inputting the pulse current of the electronically-controlled permanent magnetic chuck corresponding to the blank holder block, the purpose of providing different blank holder forces to different blank holder blocks is achieved. In other words, in order to realize multi-area distributed control of blank holder force, when dividing the blank holder area, it is necessary to consider the width of the flange area corresponding to the sheet material and the connection parameters between the blank holder block and the pressure sensor, to avoid problems such as inaccurate control of the blank holder force due to to too large or too small blank holder area.

In an embodiment, for an $i^{th}$ area, where $i \in \{1, 2, \ldots, s\}$, in a case that a ratio of the width of the flange area corresponding to the sheet material to a thread diameter d0 of the pressure sensor is greater than 2 and less than 4, the $i^{th}$ area is divided into ki blank holder areas in the radial direction, where ki=1, and a width of the blank holder in the radial direction is equal to a width of the $i^{th}$ area in the radial direction. in a case that the ratio of the width of the flange area corresponding to the sheet material to the thread diameter d0 of the pressure sensor is greater than or equal to 4, the $i^{th}$ area is divided into ki blank holder areas in the radial direction, where ki≥2, a total width of the ki blank holder areas in the radial direction is equal to the width of the $i^{th}$ area in the radial direction, wherein a width of a blank holder area in the radial direction is greater than 2d0.

For example, the narrowest width w of the blank holder block is twice the thread diameter d0 of the pressure sensor (w=2d0), when the innermost blank holder is operating, its inner edge is close to the edge of the corresponding area inside a female die of the stamping device. The flange area width corresponding to the sheet material in any straight line Lx or curve Cx area is represented by y (y>w), y/w block holder blocks should be placed on the radial direction. When 1<y/w<2, only the width of the first blank holder block needs to be adjusted to meet the blanking requirements. When y/w>2, the width of the blank holder block should be adjusted to place the smallest number of the blank holder block to meet the blanking requirements. The blank holders are closely arranged, and the widths (and thicknesses) of the blank holder blocks in the same circumferential area are the same.

In an embodiment, the number of blank holder blocks on the radial direction can also be determined based on a stamping depth h of the workpiece to be stamped or the distance of the sheet material flowing on the radial direction.

In an exemplary embodiment, the contour of the blank holder block is the same as the contour of the corresponding blank holder area, and the thickness of the blank holder block is 1.5 to 2.0 times the total thread length h0 of the pressure sensor.

In step S404, the blank holder force is controlled dynamically for each blank holder area to stamp the sheet material, so as to obtain the workpiece to be stamped.

In this embodiment, step S404 includes the above steps S102 to S104, or S202 to S204, or S302 to S306, which will not be elaborated herein.

Therefore, according the stamping method of the embodiments of the present disclosure, the contour characteristic of the workpiece to be stamped is obtained. The blank holder of the stamping device is divided into s areas in a circumferential direction based on the contour characteristic of the workpiece to be stamped, where s is an integer greater than 1. For an $i^{th}$ area, where $i \in \{1, 2, \ldots, s\}$, the $i^{th}$ area is divided into ki blank holder areas in a radial direction based on a width of a flange area corresponding to the sheet material and a thread parameter of a pressure sensor, where ki is an integer greater than or equal to 1, each blank holder area corresponds to a pressure sensor and a blank holder block, and the pressure sensor is connected to the blank holder block by threads. The blank holder force is controlled dynamically for each blank holder area to stamp the sheet material, so as to obtain the workpiece to be stamped. In this way, the blank holder area is divided for the workpieces to be stamped with different shapes and characteristics, and the blank holder area is designed according to the contour characteristic of the workpiece to be stamped, so as to provide varying blank holder forces for different areas, to achieve precise control of the blank holder force, and to optimize the molding quality.

Compared to the existing methods for dividing blank holder areas, the present disclosure divides the blank holder area according to different shapes, different internal characteristics and different relationship among different internal characteristics, thereby meeting the blank holder force requirements for each area of the multi-feature curved surface. Compared to traditional methods of generating the blank holder force through hydraulic cylinder loops, the introduction of electronically-controlled permanent magnetic chuck makes the blank holder force generated for each area meeting the requirements of the blank holder force, so that the blank holder force generation capacity of each blank holder area is improved, and the energy consumption of the production process is reduced.

In an exemplary embodiment, the stamping process can be described as follows. The system starts up. For each divided blank holder area, a variable blank holder force function is input to the controller of the stamping device, the sheet material is placed on the blank holder, and a female die of the stamping device move to the designated position to press the sheet material. The controller executes the PID control program, the PID control program outputs a pulse signal to the corresponding distributed magnetizing and demagnetizing circuit for each blank holder area, and a cyclic interrupt program in the PID control program runs. The counter N1 starts to operate, the count value of N1 is n=n+1 every time the cycle period passes. The variable blank holder force function Fij=ƒ(tij), as a set value of the PID control program Cij, changes over time. During tij, the value of Fij=ƒ(tij) decreases with the movement of the sheet material, and decreases to 0 when the sheet material reaches the inner edge of the innermost blank holder block. The real-time blank holder force data Gij measured by the pressure sensor is input to the controller of the stamping device and a host computer having a data processing function. The received blank holder force data Gij is compared with the preset real-time value of the blank holder force curve Fij=ƒ(t) to calculate the error e=Fij−Gij. The controller sets the PID parameters according to the error e, and then adjusts the state of each solid state relay. When the sheet material moves to the inner edge of the innermost blank holder block, the count value of the counter reaches a preset value, the blank holder force is 0, the die rises to the designed position, removes the sheet material, and ends the operation.

Figure 5:
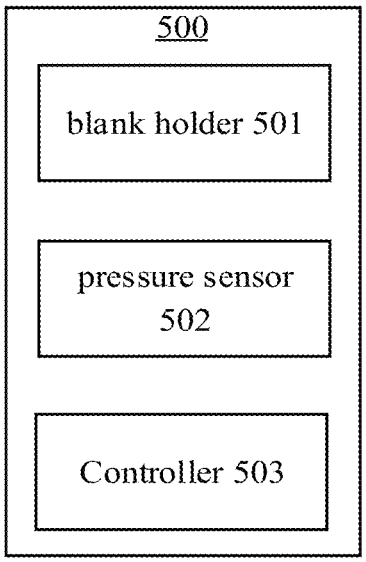
FIG. 5 is a schematic diagram illustrating an electromagnetic stamping device according to an embodiment of the present disclosure.

FIG. 5 is a schematic diagram of a stamping device 500 according to an embodiment of the present disclosure. As shown in FIG. 5, the stamping device 500 includes: a blank holder 501, a plurality of pressure sensors 502 and a controller 503. The blank holder 501 has a plurality of blank holder areas divided based on a contour characteristic of a workpiece to be stamped. The plurality of pressure sensors 502 have a one-to-one correspondence with the plurality of blank holder areas, each pressure sensor is configured to collect blank holder force data G of a corresponding blank holder area every cycle period t0. The controller 503 is configured to control a blank holder force for each blank holder area based on an error between the blank holder force data G and a value F of a blank holder force function set over time for the blank holder area at a current time, where e=F−G, and to obtain the workpiece to be stamped by stamping sheet material under the blank holder force.

According to the embodiments of the present disclosure, a blank holder of a stamping device is divided into a plurality of blank holder areas based on a contour characteristic of a workpiece to be stamped. A blank holder force function over time is set for each blank holder area based on a shape characteristic of the blank holder area. Blank holder force data G of each blank holder area is obtained every cycle period t0, and an error e between the blank holder force data G and a value F of the blank holder force function at a current time is calculated, where e=F−G. A blank holder force for each blank holder area is controlled based on the error, and the workpiece to be stamped is obtained by stamping the sheet material under the blank holder force. In this way, it is possible to provide different blank holder forces for forming areas with different characteristics and at different stamping stages. At the same time, the negative feedback mechanism is used to monitor the blank holder force dynamically in real time, to improve the loading accuracy of the blank holder force, and accurately control the metal flow of the sheet material, optimize molding quality, reduce energy consumption, and avoid molding cracks, wrinkles and springback defects.

Figure 6:
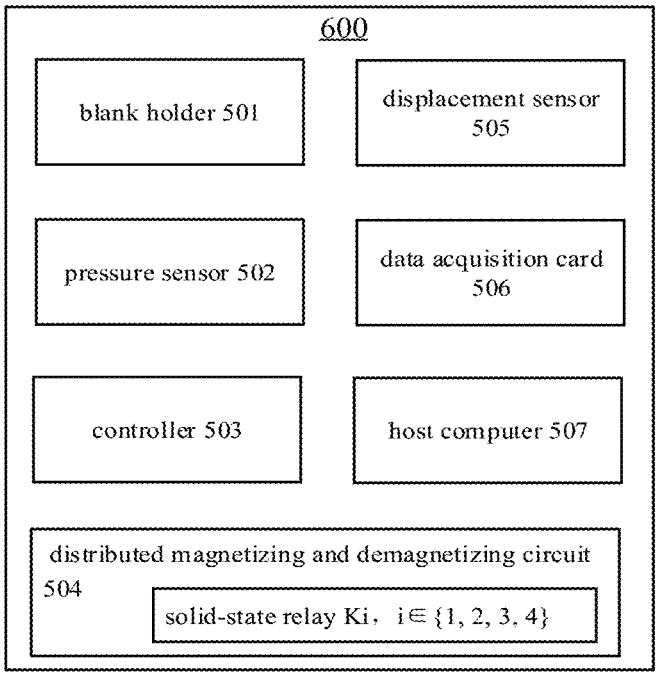
FIG. 6 is a schematic diagram illustrating an electromagnetic stamping device according to another embodiment of the present disclosure.

FIG. 6 is a schematic diagram of a stamping device 600 according to another embodiment of the present disclosure. As shown in FIG. 6, the stamping device 600 includes: a blank holder 501, a plurality of pressure sensors 502, a controller 503, a plurality of distributed magnetizing and demagnetizing circuits 504, a plurality of displacement sensors 505, a data acquisition card 506, and a host computer 507. The distributed magnetizing and demagnetizing circuit 504 includes a plurality of solid state relays K1, where i∈{1, 2, 3, 4}.

In an exemplary embodiment, the blank holder 501 has a plurality of blank holder areas divided based on a contour characteristic of a workpiece to be stamped. A plurality of pressure sensors have a one-to-one correspondence with the plurality of blank holder areas, each pressure sensor is configured to collect blank holder force data G of a corresponding blank holder area every cycle period t0. The controller 503 is configured to control the blank holder force by outputting at least one of a switching quantity signal, a pulse signal, and a pulse width modulation (PWM) signal to the distributed magnetizing and demagnetizing circuits 504 corresponding to the plurality of blank holder areas based on the error between the blank holder force data G and a value F of a blank holder force function set over time for the blank holder area at a current time, where e=F−G, thereby improving the control accuracy of the blank holder force, reducing the influence of multi-magnetic field coupling and external interference. The blank holder force generated by the electronically controlled permanent magnet chuck is stable and continuous, which improves the loading capacity of the blank holder force and reduces the energy consumption of the blanking process.

In an exemplary embodiment, each distributed magnetizing and demagnetizing circuit 504 includes four solid-state relays K1, where i∈{1, 2, 3, 4}, the controller 503 is further configured to: output the pulse signal to a solid-state relay K3 to cause the solid-state relay K3 to be on or off cyclically with a fixed duty cycle, wherein a frequency of the pulse signal is greater than 5 times a frequency of the PWM signal; adjust a duty cycle of the PWM signal based on the error to cause a solid-state relay K4 to be on or off cyclically with a flexible duty cycle, wherein an absolute value of the error is proportional to the duty cycle of the PWM signal; output a positive switching quantity signal to a solid-state relay K1 in response to the error being greater than 0, to cause the solid-state relay K1 to be on to magnetize the distributed magnetizing and demagnetizing circuit 504; and output the positive switching quantity signal to a solid-state relay K2 in response to the error being less than or equal to 0, to cause the solid-state relay K2 to be on to demagnetize the distributed magnetizing and demagnetizing circuit 504.

In an exemplary embodiment, the value of the blank holder force function is 0 when stamping an inner edge of the innermost blank holder area leaving away from the edge of the sheet material. Each of the plurality of displacement sensors 505 is configured to collect deformation data of the sheet material every cycle period t0, and the controller 503 is configured to send an alarm instruction and stop stamping in response to the deformation data being greater than 1.5 times an initial thickness of the sheet material.

In an exemplary embodiment, a data acquisition card 506 is connected with a pressure sensor 502, a displacement sensor 505 and a host computer 507, to store the data fed back by the sensor and provide the data to the host computer 507. The host computer 507 analyzes the data provided by the data acquisition card 506. The controller 503 is connected to the pressure sensor 502 and the displacement sensor 505, the solid state relay Ki in the distributed magnetizing and demagnetizing circuit 504 and the host computer 507, to cause the solid-state relay to be on or off according to the analysis result of the host computer 507. The distributed magnetizing and demagnetizing circuit 504 is connected to an electrically-controlled permanent magnetic chuck (not shown in FIG. 6) to magnetize and demagnetize the electrically-controlled permanent magnetic chuck, thereby attracting a force-enhancing plate (not shown in FIG. 6) to generate the blank holder force.

The specific manner of each module in the device of the foregoing embodiments performing operations has been described in detail in the method embodiments, which will not be elaborated herein. In addition, the area division of the blank holder has been described in detail in the method embodiments, which will not be elaborated herein.

With the embodiments of the present disclosure, it is possible to divide the blank holder area for the workpieces to be stamped with different shape characteristics, and design the blank holder area according to the contour characteristic of the workpiece to be stamped, so as to provide varying blank holder forces for different areas to achieve precise control of the blank holder force and to optimize molding quality.

Figure 7:
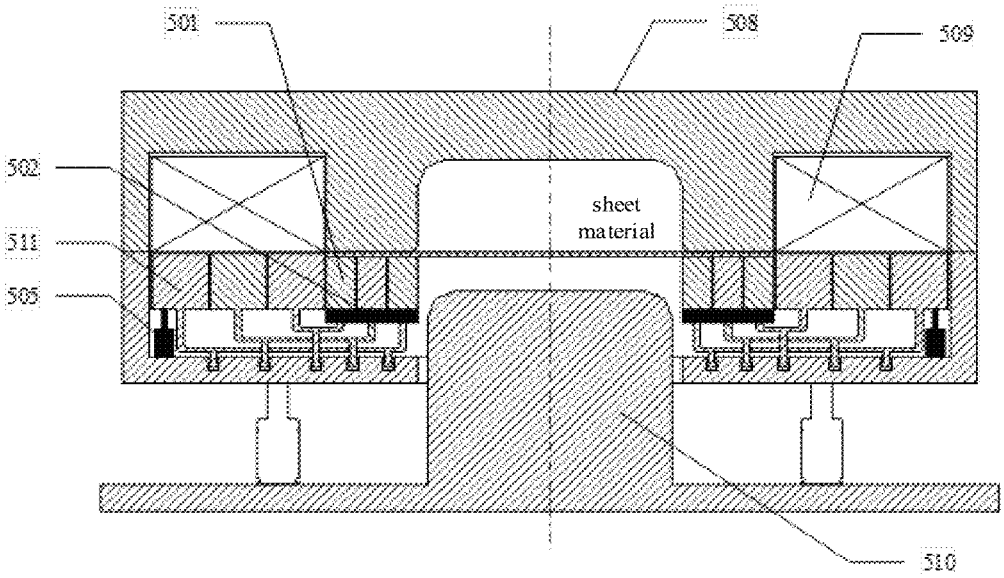
FIG. 7 is a structural diagram illustrating an electromagnetic stamping device according to an embodiment of the present disclosure.
Figure 8:
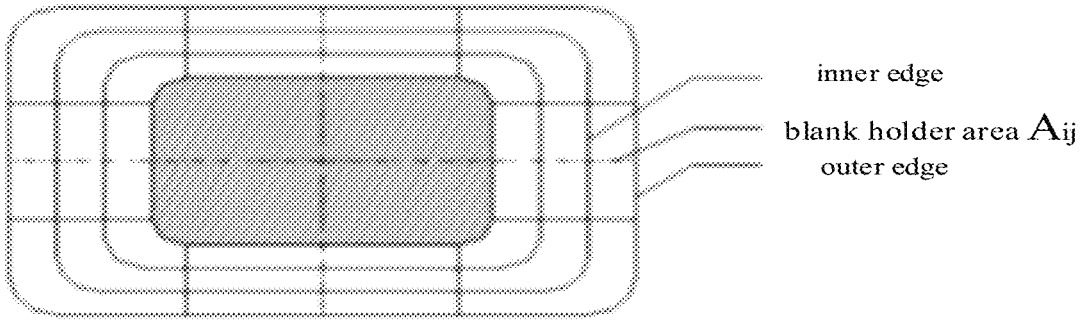
FIG. 8 is a schematic diagram illustrating area division of the blank holder of the electromagnetic stamping device of FIG. 7.

In detail, as shown in FIG. 7, taking a box-shaped stamping part as an example, FIG. 7 is a structural diagram of a stamping device according to an embodiment of the present disclosure. The stamping device includes: the blank holder 501, the plurality of pressure sensors 502, the plurality of displacement sensors 505, a female die 508, an electrically-controlled permanent magnetic chuck 509, a male die 510 and a force-enhancing plate 511. The blank holder 501 is divided into s areas in the circumferential direction on a two-dimensional plane, and the $i^{th}$ area is divided into ki blank holder areas in the radial direction, a total of $\Sigma_{i=1}^{s} k_i$ blank holder areas, which can be obtained by dividing the method embodiment corresponding to FIG. 4, and the divided blank holder area is shown in FIG. 8. The embodiment shown in FIG. 8 takes as an example that the flange area corresponding to each area of the sheet material has the same width, and the thread diameter of each pressure sensor is the same, so the number of blank holder areas obtained by radially dividing each circumferential area is the same.

Each blank holder area corresponds to a blank holder block in the three-dimensional space, and any blank holder is represented by Yij, $i \in \{1, 2, \ldots, s\}$, $j \in \{1, 2, \ldots, k\}$. A blank holder block and the electronically-controlled permanent magnetic chuck 509, the force-enhancing plate 511, the pressure sensor 502 and the displacement sensor 505 corresponding to the blank holder block form a blank holder unit, and any blank holder unit is represented as Dij. The electrically-controlled permanent magnetic chuck 509 is installed above the force-enhancing plate 511, the pressure sensor 502 is installed below the blank holder block, and the displacement sensor 505 is installed between the force-enhancing plate 511 and the male die 510.

Figure 9:
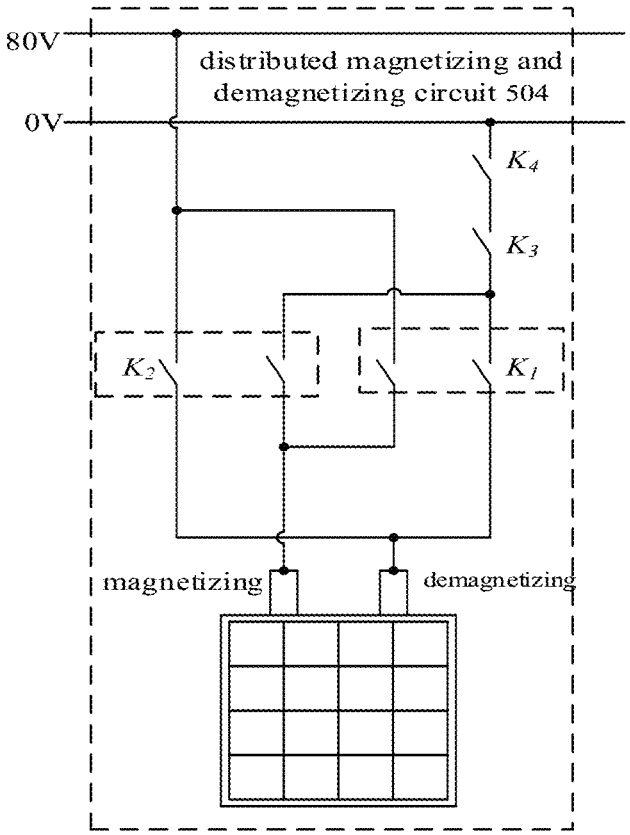
FIG. 9 is a diagram illustrating a distributed magnetizing and demagnetizing circuit according to an embodiment of the present disclosure.

The distributed magnetizing and demagnetizing circuit 504 connected to the blank holder unit Dij is represented as Uij, $i \in \{1, 2, \ldots, s\}$, $j \in \{1, 2, \ldots, k\}$. In the distributed magnetizing and demagnetizing circuit Uij, the solid state relay K1 is controlled to be on or off by the PID control program Cij, and the distributed magnetizing and demagnetizing circuit Uij outputs the pulse current. FIG. 9 is a circuit diagram of a distributed magnetizing and demagnetizing circuit according to an embodiment of the present disclosure.

For each blank holder unit Dij, the electrically-controlled permanent magnetic chuck 509 is magnetized and demagnetized by the pulse current output by the distributed magnetizing and demagnetizing circuit Uij, and the force-enhancing plate 511 is caused to generate the blank holder force. The blank holder force generated by the electronically-controlled permanent magnetic chuck is stable and continuous, which improves the loading capacity of the blank holder force and reduces the energy consumption of the blank holder process.

The pressure sensor 502 collects the blank holder force data every cycle period t0, and the displacement sensor 505 collects the sheet material deformation data every cycle period t0, and inputs the data to the controller 503 and the data acquisition card (not shown in FIG. 7).

The data acquisition card transmits the real-time data measured by the pressure sensor 502 and the displacement sensor 505 to the host computer (not shown in FIG. 7). The host computer has a built-in data processing program for saving and analyzing the data, and feeding back to the controller 503.

The controller 503 can adjust the loading of the pulse current according to the magnitude of the feedback value to weaken the influence of multi-magnetic field coupling and external interference, and improve the control accuracy. In detail, when the deformation data is greater than 1.5 times the initial thickness of the sheet material, the controller 503 sends an alarm instruction and stops the stamping process. According to the error e between the blank holder force data G and a value F of the blank holder force function at a current time, where e=F−G, the controller 503 controls the blank holder force applied on this area to make the actual blank holder force approaches the value of the blank holder force function at the moment when the blank holder force data G is collected.

In detail, the controller 503 outputs a switching quantity signal, a pulse signal, and a PWM signal to the distributed magnetizing and demagnetizing circuit 504, so as to control the state of the solid state relay. The solid state relay K1 is controlled by the switching quantity signal, the solid state relay K1 is closed, which means that the circuit is magnetized. The solid state relay K2 is controlled by the switching quantity signal, and the solid state relay K2 is closed, which means the circuit is demagnetized. The solid state relay K3 is controlled by the pulse signal, and the solid state relay K3 is caused to be on or off cyclically with a fixed duty cycle, which means that the circuit outputs the pulse current for magnetizing and demagnetizing. The solid state relay K4 is controlled by the PWM signal, the solid state relay K4 is caused to be on or off cyclically with a variable duty cycle, which means that the speed change of magnetizing and demagnetizing of the circuit, to realize the control of the blank holder force of each blank holder area.

Figure 10:
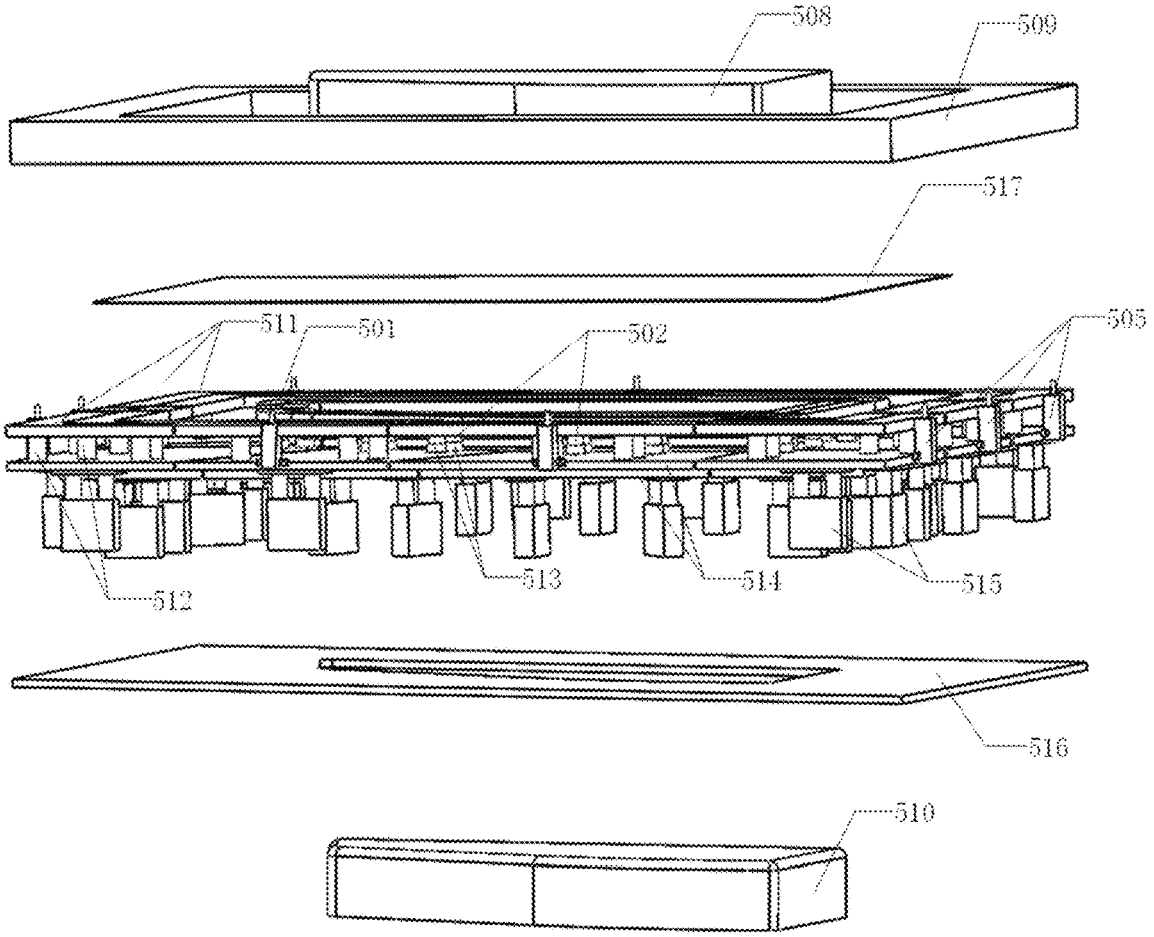
FIG. 10 is a stereogram illustrating an electromagnetic stamping device according to an embodiment of the present disclosure.

In an exemplary embodiment, as shown in FIG. 10, taking a stamping part in a shape of a vehicle door as an example, FIG. 10 is a three-dimensional structural diagram of a stamping device according to an embodiment of the present disclosure. The stamping device includes a plurality of pressure sensors 502, a plurality of displacement sensors 505, a female die 508, an electrically-controlled permanent magnetic chuck 509, a male die 510, a force-enhancing plate 511, a connecting rod 512 of the force-enhancing plate, a connecting rod 513 of the blank holder block, a connecting block 514, and a guide rod cylinder 515.

In detail, the lower surface of the electrically-controlled permanent magnetic chuck 509 is a magnetic force generating surface, and the die 508 with a multi-feature curved surface contour is set at the center. The upper surface of the female die 508 is aligned with the lower surface of the electrically-controlled permanent magnetic chuck 509, the sheet material 517 is placed under the female die 508. The blank holder 501 is arranged right above the outer edge of the sheet material 517, the blank holder block is connected to the upper bottom surface of the pressure sensor 502, the lower bottom surface of the pressure sensor 502 is connected to the upper bottom surface of the connecting rod 513 of the blank holder block, and the lower bottom surface of the connecting rod 513 of the blank holder block is connected to the radial inner side of the connecting block 514 and arranged from the inside to the outside in a radial direction. The radial outer side of the connecting block 514 is connected to the lower bottom surface of the connecting rod 512 of the force-enhancing plate, and the upper bottom surface of the connecting rod 512 of the force-enhancing plate is connected to the force-enhancing plate 511. The force-enhancing plate 511 is distributed directly under the electrically-controlled permanent magnetic chuck and is parallel to the lower surface of the electrically-controlled permanent magnetic chuck, and the movement direction of the force-enhancing plate 511 is perpendicular to the lower surface of the electrically-controlled permanent magnetic chuck 509. The outer side of the connecting block 514 is equipped with the displacement sensor 505, which is perpendicular to the plane where the force-enhancing plate 511 is located. The lower bottom surface of the connecting block 514 is connected to the guide rod side of the guide rod cylinder 515, and the cylinder side of the guide rod cylinder 515 is connected with a connecting plate 516, the center of the connecting plate 516 is provided with the male die 510 with a multi-characteristic curved contour. The number of guide rod cylinders 515 is determined by the weight and size of the connecting block, which meets its load-bearing requirements and is installed at a relatively center. The guide rod cylinder 515 can enable all blank holder blocks to return to a same level in a case that the device stops operating.

The thickness of all booster plates is the same as that of the blank holder block. The inner edge of the innermost force-enhancing plate is parallel to the inner edge of the electronically-controlled permanent magnetic chuck and is located on the same horizontal plane. The inner boundary shape is determined by the shape of the electrically-controlled permanent magnetic chuck corresponding to the blank holder area. The upper and lower boundaries are determined by extending the vertical line of the dividing point of each blank holder area. The outer boundary is determined by the width of the force-enhancing plate, and its width is determined by the required blank holder force. The inner boundary shape of the adjacent outer force-enhancing plate is the same as the outer boundary shape of the innermost force-enhancing plate. The upper and lower boundaries are determined by the extension of the vertical line of the dividing point of each blank holder area. The outer boundary is determined by the width of the force-enhancing plate, and its width is determined by the required blank holder force. Finally, the width of all the force-enhancing plates is the same as the width of the electronically-controlled permanent magnetic chucks to ensure sufficient force on the force-enhancing plate.

Figure 11:
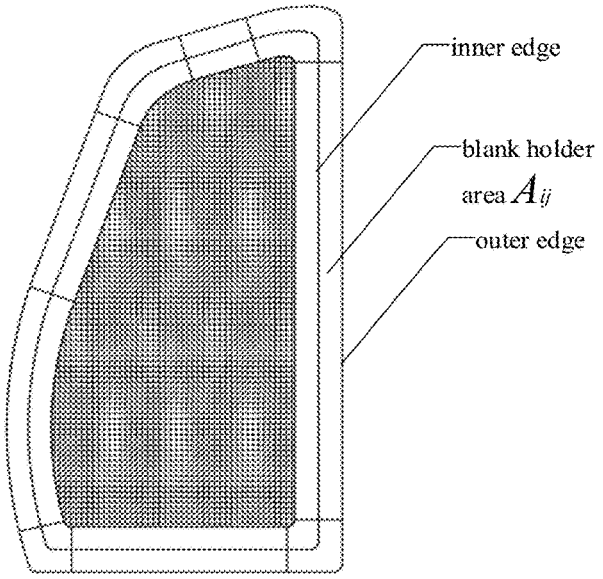
FIG. 11 is a schematic diagram illustrating area division of the blank holder of the electromagnetic stamping device of FIG. 10.

The blank holder 501 is divided into s areas along the circumferential direction on a two-dimensional plane. The $i^{th}$ area is divided into ki blank holder areas in the radial direction. The front end of the blank holder block in the $i^{th}$ area is connected to the end of the blank holder block in the $(i+1)^{th}$ area to form a total of $\Sigma_{i=1}^{s} k_i$ blank holder areas. The shape enclosed by the blank holder 501 is the same as the shape of the die 508, which can be obtained by dividing the method embodiment corresponding to FIG. 4, and a divided blank holder area is shown in FIG. 11. In the embodiment shown in FIG. 11, the width of the flange area corresponding to each area of the sheet material is the same, and the thread diameter of each pressure sensor is the same, so the number of blank holder areas obtained by radially dividing each area is the same.

In an exemplary embodiment, a range of a spacing between the force-enhancing plates corresponding to two adjacent blank holder areas is 2 mm to 3 mm, to reduce squeezing of the force-enhancing plates at different areas after being stressed. A distance between the connecting blocks 514 corresponding to two adjacent blank holder areas ranges from 2 mm to 3 mm, so that the connecting blocks 514 can have a buffer space when the connecting blocks 514 are slightly displaced in response to force during the stamping process.

The connecting block 514 is connected with a required number of guide rod cylinders 515, and the guide rod cylinders 515 are configured to enable all blank holder blocks to return to a same level in a case that the device stops operating.

The present disclosure also provides a non-transitory computer-readable storage medium. When the instructions in the storage medium are executed by the processor, the processor executes the method described in the embodiments of the present disclosure. The non-transitory computer-readable storage medium may be ROM, random access memory (RAM), CD-ROM, magnetic tape, floppy disk, and optical data storage device.

It should be understood that "several" mentioned in the present disclosure refers to one or more, and "a plurality of" refers to two or more. The term "and/or" describes an association relationship among the associated objects, indicating that there are three types of relationships, for example, A and/or B, i.e., A alone exists, A and B exist at the same time, and B exists alone. The character "/" generally indicates that the associated objects before and after are in an "or" relationship. The singular forms "a", "said" and "the" are also intended to include plural forms, unless the context clearly indicates other meanings.

It can be further understood that the terms "first" and "second" are used to describe various information, but the information should not be limited to these terms. These terms are only used to distinguish the same type of information from each other, and do not indicate a specific order or degree of importance. In fact, expressions such as "first" and "second" can be used interchangeably. For example, without departing from the scope of the present disclosure, the first information may also be referred to as second information, and similarly, the second information may also be referred to as the first information.

It is further understood that, unless otherwise specified, "connected" includes a direct connection between the two without other components, and also includes an indirect connection between the two with other elements.

It is understood that, although the operations are described in a specific order in the drawings in the embodiments of the present disclosure, the operations do not need to be performed in the specific order shown or in a serial order, or are required to be performed to get a desired result. In certain circumstances, multitasking and parallel processing may be advantageous.

Other embodiments of the present disclosure will be apparent to those skilled in the art from consideration of the specification and practice of the present disclosure disclosed here. This application is intended to cover any variations, uses, or adaptations of the present disclosure following the general principles thereof and including such departures from the present disclosure as come within known or customary practice in the art. It is intended that the specification and examples be considered as exemplary only, with a true scope and spirit of the present disclosure being indicated by the claims.

It will be appreciated that the present disclosure is not limited to the exact construction that has been described above and illustrated in the accompanying drawings, and that various modifications and changes can be made without departing from the scope thereof. It is intended that the scope of the present disclosure only be limited by the appended claims.

What is claimed is:

1. An electromagnetic stamping method, comprising:

dividing a blank holder of a stamping device into a plurality of blank holder areas based on a contour characteristic of a workpiece to be stamped;

setting a blank holder force function over time for each blank holder area based on a shape characteristic of the blank holder area;

collecting blank holder force data G of each blank holder area every cycle period t0, and calculating an error e between the blank holder force data G and a value F of the blank holder force function at a current time, where e=F−G;

controlling a blank holder force for each blank holder area based on the error, and obtaining the workpiece to be stamped by stamping sheet material under the blank holder force; and collecting deformation data of the sheet material every cycle period t0, sending an alarm instruction and stopping stamping in response to the deformation data being greater than 1.5 times an initial thickness of the sheet material.

2. The method of claim 1, wherein the stamping device comprises a plurality of distributed magnetizing and demagnetizing circuits corresponding to the plurality of blank holder areas, and controlling the blank holder force for each blank holder area based on the error comprises:

controlling the blank holder force by outputting at least one of a switching quantity signal, a pulse signal, and a pulse width modulation (PWM) signal to the distributed magnetizing and demagnetizing circuits corresponding to the plurality of blank holder areas based on the error.

3. The method of claim 2, wherein each distributed magnetizing and demagnetizing circuit comprises four solid-state relays Ki, where i∈{1, 2, 3, 4}, Ki is in a disconnected state in an initial condition for stamping the sheet material, and outputting at least one of the switching quantity signal, the pulse signal, and the PWM signal to the distributed magnetizing and demagnetizing circuits corresponding to the plurality of blank holder areas based on the error comprises:

outputting the pulse signal to a solid-state relay K3 to cause the solid-state relay K3 to be on or off cyclically with a fixed duty cycle, wherein a frequency of the pulse signal is greater than 5 times a frequency of the PWM signal;

adjusting a duty cycle of the PWM signal based on the error to cause a solid-state relay K4 to be on or off cyclically with a flexible duty cycle, wherein an absolute value of the error is proportional to the duty cycle of the PWM signal;

outputting a positive switching quantity signal to a solid-state relay K1 in response to the error being greater than 0, to cause the solid-state relay K1 to be on to magnetize the distributed magnetizing and demagnetizing circuit; and outputting the positive switching quantity signal to a solid-state relay K2 in response to the error being less than or equal to 0, to cause the solid-state relay K2 to be on to demagnetize the distributed magnetizing and demagnetizing circuit.

4. The method of claim 1, wherein a value of the blank holder force function is calculated as F=P×S, where P represents a pressure required to stamp the sheet material at a current moment, S represents a contact area between the sheet material and the blank holder area at the current moment, and the value of the blank holder force function is 0 at a moment when an edge of the sheet material is leaving away from an inner edge of the blank holder area.

5. The method of claim 1, wherein dividing the blank holder of the stamping device into the plurality of blank holder areas based on the contour characteristic of the workpiece to be stamped comprises:

obtaining the contour characteristic of the workpiece to be stamped;

dividing the blank holder of the stamping device into s areas in a circumferential direction based on the contour characteristic of the workpiece to be stamped, where s is an integer greater than 1;

for an $i^{th}$ area, where i∈{1, 2, . . . , s), dividing the $i^{th}$ area into ki blank holder areas in a radial direction based on a width of a flange area corresponding to the sheet material and a thread parameter of a pressure sensor, where ki is an integer greater than or equal to 1, each blank holder area corresponds to a pressure sensor and a blank holder block, and the pressure sensor is connected to the blank holder block by threads; and controlling the blank holder force dynamically for each blank holder area to stamp the sheet material, so as to obtain the workpiece to be stamped.

6. The method of claim 5, wherein the contour characteristic comprises at least one of a straight line and a curve, and dividing the blank holder of the stamping device into s areas in the circumferential direction based on the contour characteristic of the workpiece to be stamped comprises:

in a case that a straight line La is connected to a curve Ca, determining an area formed by the straight line La, a first vertical line of the straight line La passing through one end point of the straight line La, a second vertical line of the straight line La passing through a connection point of the straight line La and the curve Ca, and a line segment between points where the first vertical line and the second vertical line intersect with an outer edge of the blank holder as a first area; determining an area formed by the curve Ca, a third vertical line perpendicular to a tangent line passing through one end of the curve Ca, the second vertical line, a curve between the points where the second vertical line and the third vertical line intersect with the outer edge of the blank holder as a second area, wherein a curvature q at the connection point of the straight line La and the curve Ca is 0;

in a case that a curve Cb is connected to a curve Cc and curvatures of the curve Cb and the curve Cc satisfy (qmax−qmin)/qmax≥0.05, determining an area formed by the curve Cb, a fourth vertical line perpendicular to a tangent line passing through one end point of the curve Cb, a fifth vertical line perpendicular to a tangent line passing through a connection point of the curve Cb and the curve Cc, and a curve between points where the fourth vertical line and the fifth vertical line intersect with the outer edge of the blank holder as a third area; and determining an area formed by the curve Cc, a sixth vertical line perpendicular to a tangent line passing through one end of the curve Cc, the fifth vertical line, and the curve between points where the fifth vertical line and the sixth vertical line intersect with the outer edge of the blank holder as a fourth area, where qmax represents a maximum value of curvatures of points on the curve Cb or the curve Cc, qmin represents a minimum value of the curvatures of points on the curve Cb or the curve Cc, and a curvature change rate at the connection point of the curve Cb and the curve Cc is the largest; and in a case that the curve Cb is connected to the curve Cc and the curvature of the curve Cb and the curve Cc fails to satisfy (qmax−qmin)/qmax≥0.05, determining an area formed by the curve Cb, the curve Cc, the fourth vertical line, the sixth vertical line, and a curve between points where the fourth vertical line and the sixth vertical line intersect with the outer edge of the blank holder as a fifth area.

7. The method of claim 5, wherein dividing the $i^{th}$ area into ki blank holder areas in the radial direction based on the width of the flange area corresponding to the sheet material and the thread parameter of the pressure sensor comprises:

in a case that a ratio of the width of the flange area corresponding to the sheet material to a thread diameter d0 of the pressure sensor is greater than 2 and less than 4, dividing the $i^{th}$ area into ki blank holder areas in the radial direction, where ki=1, and a width of the blank holder in the radial direction is equal to a width of the $i^{th}$ area in the radial direction; and in a case that the ratio of the width of the flange area corresponding to the sheet material to the thread diameter d0 of the pressure sensor is greater than or equal to 4, dividing the $i^{th}$ area into ki blank holder areas in the radial direction, where ki≥2, a total width of the ki blank holder areas in the radial direction is equal to the width of the $i^{th}$ area in the radial direction, wherein a width of a blank holder area in the radial direction is greater than 2d0.

8. The method of claim 5, wherein a contour of the blank holder block is the same as a contour of the corresponding blank holder area, and a thickness of the blank holder block is 1.5 to 2.0 times a total thread length h0 of the pressure sensor.

9. An electromagnetic stamping device, comprising:

a blank holder, having a plurality of blank holder areas divided based on a contour characteristic of a workpiece to be stamped;

a plurality of pressure sensors, having a one-to-one correspondence with the plurality of blank holder areas, wherein each pressure sensor is configured to collect blank holder force data G of a corresponding blank holder area every cycle period t0;

a controller, configured to control a blank holder force for each blank holder area based on an error between the blank holder force data G and a value F of a blank holder force function set over time for the blank holder area at a current time, where e=F−G, and to obtain the workpiece to be stamped by stamping sheet material under the blank holder force; and a plurality of displacement sensors corresponding to the plurality of blank holder areas, each displacement sensor is configured to collect deformation data of the sheet material every cycle period t0;

wherein the controller is configured to send an alarm instruction and stop stamping in response to the deformation data being greater than 1.5 times an initial thickness of the sheet material.

10. The device of claim 9, wherein the stamping device comprises a plurality of distributed magnetizing and demagnetizing circuits corresponding to the plurality of blank holder areas, and the controller is further configured to:

control the blank holder force by outputting at least one of a switching quantity signal, a pulse signal, and a pulse width modulation (PWM) signal to the distributed magnetizing and demagnetizing circuits corresponding to the plurality of blank holder areas based on the error.

11. The device of claim 10, wherein each distributed magnetizing and demagnetizing circuit comprises four solid-state relays Ki, where i∈{1, 2, 3, 4}, Ki is in a disconnected state in an initial condition for stamping the sheet material, and the controller is further configured to:

output the pulse signal to a solid-state relay K3 to cause the solid-state relay K3 to be on or off cyclically with a fixed duty cycle, wherein a frequency of the pulse signal is greater than 5 times a frequency of the PWM signal;

adjust a duty cycle of the PWM signal based on the error to cause a solid-state relay K4 to be on or off cyclically with a flexible duty cycle, wherein an absolute value of the error is proportional to the duty cycle of the PWM signal;

output a positive switching quantity signal to a solid-state relay K1 in response to the error being greater than 0, to cause the solid-state relay K1 to be on to magnetize the distributed magnetizing and demagnetizing circuit; and output the positive switching quantity signal to a solid-state relay K2 in response to the error being less than or equal to 0, to cause the solid-state relay K2 to be on to demagnetize the distributed magnetizing and demagnetizing circuit.

12. The device of claim 9, wherein a value of the blank holder force function is calculated as F=P×S, where P represents a pressure required to stamp the sheet material at a current moment, S represents a contact area between the sheet material and the blank holder area at the current moment, and the value of the blank holder force function is 0 at a moment when an edge of the sheet material is leaving away from an inner edge of the blank holder area.

13. The device of claim 9, wherein the controller is configured to:

obtain the contour characteristic of the workpiece to be stamped;

divide the blank holder of the stamping device into s areas in a circumferential direction based on the contour characteristic of the workpiece to be stamped, where s is an integer greater than 1;

for an $i^{th}$ area, where i∈{1, 2, . . . , s), divide the $i^{th}$ area into ki blank holder areas in a radial direction based on a width of a flange area corresponding to the sheet material and a thread parameter of a pressure sensor, where ki is an integer greater than or equal to 1, each blank holder area corresponds to a pressure sensor and a blank holder block, and the pressure sensor is connected to the blank holder block by threads; and control the blank holder force dynamically for each blank holder area to stamp the sheet material, so as to obtain the workpiece to be stamped.

14. The device of claim 13, wherein the contour characteristic comprises at least one of a straight line and a curve, and the controller divides the blank holder of the stamping device into s areas in the circumferential direction by acts of:

in a case that a straight line La is connected to a curve Ca, determining an area formed by the straight line La, a first vertical line of the straight line La passing through one end point of the straight line La, a second vertical line of the straight line La passing through a connection point of the straight line La and the curve Ca, and a line segment between points where the first vertical line and the second vertical line intersect with an outer edge of the blank holder as a first area; determining an area formed by the curve Ca, a third vertical line perpendicular to a tangent line passing through one end of the curve Ca, the second vertical line, a curve between the points where the second vertical line and the third vertical line intersect with the outer edge of the blank holder as a second area, wherein a curvature q at the connection point of the straight line La and the curve Ca is 0;

in a case that a curve Cb is connected to a curve Cc and curvatures of the curve Cb and the curve Cc satisfy (qmax−qmin)/qmax≥0.05, determining an area formed by the curve Cb, a fourth vertical line perpendicular to a tangent line passing through one end point of the curve Cb, a fifth vertical line perpendicular to a tangent line passing through a connection point of the curve Cb and the curve Cc, and a curve between points where the fourth vertical line and the fifth vertical line intersect with the outer edge of the blank holder as a third area; and determining an area formed by the curve Cc, a sixth vertical line perpendicular to a tangent line passing through one end of the curve Cc, the fifth vertical line, and the curve between points where the fifth vertical line and the sixth vertical line intersect with the outer edge of the blank holder as a fourth area, where qmax represents a maximum value of curvatures of points on the curve Cb or the curve Cc, qmin represents a minimum value of the curvatures of points on the curve Cb or the curve Cc, and a curvature change rate at the connection point of the curve Cb and the curve Cc is the largest; and in a case that the curve Cb is connected to the curve Cc and the curvature of the curve Cb and the curve Cc fails to satisfy $(qmax-qmin)/qmax \geq 0.05$, determining an area formed by the curve Cb, the curve Cc, the fourth vertical line, the sixth vertical line, and a curve between points where the fourth vertical line and the sixth vertical line intersect with the outer edge of the blank holder as a fifth area.

15. The device of claim 13, wherein the controller divides the $i^{th}$ area into ki blank holder areas in the radial direction by:

in a case that a ratio of the width of the flange area corresponding to the sheet material to a thread diameter d0 of the pressure sensor is greater than 2 and less than 4, dividing the $i^{th}$ area into ki blank holder areas in the radial direction, where ki=1, and a width of the blank holder in the radial direction is equal to a width of the $i^{th}$ area in the radial direction; and in a case that the ratio of the width of the flange area corresponding to the sheet material to the thread diameter d0 of the pressure sensor is greater than or equal to 4, dividing the $i^{th}$ area into ki blank holder areas in the radial direction, where $ki \geq 2$, a total width of the ki blank holder areas in the radial direction is equal to the width of the $i^{th}$ area in the radial direction, wherein a width of a blank holder area in the radial direction is greater than 2d0.

16. The device of claim 13, wherein a contour of the blank holder block is the same as a contour of the corresponding blank holder area, and a thickness of the blank holder block is 1.5 to 2.0 times a total thread length h0 of the pressure sensor.

17. The device of claim 9, wherein each blank holder area corresponds to a pressure sensor and a blank holder block; the device further comprises a plurality of force-enhancing plates, a plurality of displacement sensors and a plurality of electronically-controlled permanent magnetic chucks corresponding to a plurality of blank holder blocks; a blank holder unit is formed by a blank holder block and an electronically-controlled permanent magnetic chuck, a force-enhancing plate, a pressure sensor and a displacement sensor corresponding to the blank holder block; and the blank holder unit is configured to perform stamping on each blank holder area by dynamically controlling the blank holder force;

the blank holder block is connected to an upper bottom surface of the pressure sensor; a lower bottom surface of the pressure sensor is connected to an upper bottom surface of a connecting rod of the blank holder block; a lower bottom surface of the connecting rod of the blank holder block is connected to a radial inner side of a connecting block and is arranged in order from inside to outside; a radial outer side of the connecting block is connected to a lower bottom surface of a connecting rod of the force-enhancing plate; an upper bottom surface of the connecting rod of the force-enhancing plate is connected to the force-enhancing plate; the force-enhancing plate is distributed directly under the electronically-controlled permanent magnetic chuck; an outer side of the connecting block is equipped with the displacement sensor, and the displacement sensor is perpendicular to a plane where the force-enhancing plate is located; a lower bottom surface of the connecting block is connected to a guide rod side of a guide rod cylinder, and a cylinder side of the guide rod cylinder is connected to a connecting plate; a convex with a multi-feature curved profile is provided at a center of the connecting plate; a number of guide rod cylinders is determined by a weight and a size of the connecting block to meet load-bearing requirements and the guide rod cylinders are mounted at a relative center of the connecting block; and the guide rod cylinders are configured to enable all blank holder blocks to return to a same level in a case that the device stops operating.

* * * * *